US005147412A

United States Patent [19]

Klinksiek et al.

[11] Patent Number: 5,147,412

[45] Date of Patent: Sep. 15, 1992

[54] PRODUCTION OF DISPERSIONS OF SPHERICAL PARTICLES BY CRYSTALLIZATION OF EMULSIONS

[75] Inventors: Bernd Klinksiek, Bergisch-Gladbach; Dietmar Kalz, Neunkirchen-Seelscheid; Carsten Gerdes; Ferdinand Kümmeler, both of Leverkusen; Gunter Heinrich, Leverkusen; Karl Reizlein, Cologne; Manfred Zimmermann, Monheim, all of Fed. Rep. of Germany

[73] Assignee: Bayer Aktiengesellschaft, Leverkusen, Fed. Rep. of Germany

[21] Appl. No.: 800,700

[22] Filed: Dec. 2, 1991

Related U.S. Application Data

[63] Continuation of Ser. No. 525,414, May 18, 1990, abandoned.

[30] Foreign Application Priority Data

May 20, 1989 [DE] Fed. Rep. of Germany ..... 3916465

[51] Int. Cl.[5] ..... D01H 5/18

[52] U.S. Cl. ..... 23/293 R; 23/293 A; 23/295 R; 585/812; 422/245; 366/176; 239/421; 423/659; 502/8

[58] Field of Search ..... 585/9, 812; 423/659; 422/245; 366/172, 173, 176; 252/304, 310; 239/420, 421, 433; 208/29; 23/293 A, 293 R, 295 A, 295 R; 502/8

[56] References Cited

U.S. PATENT DOCUMENTS

| | | | |
|---|---|---|---|
| 1,157,092 | 10/1915 | du Rell | 366/173 |
| 2,435,379 | 2/1948 | Archibald | 502/8 |
| 2,616,857 | 11/1952 | Shabaker | 502/8 |
| 3,872,217 | 3/1975 | Merz | 423/338 |
| 4,011,096 | 3/1977 | Sandell | 106/288 B |
| 4,549,813 | 10/1985 | Volz | 366/160 |
| 4,989,988 | 2/1991 | Hütter et al. | 366/150 |
| 4,996,004 | 2/1991 | Bücheler et al. | 252/314 |
| 5,011,293 | 4/1991 | Roop et al. | 366/173 |

FOREIGN PATENT DOCUMENTS

| | | | |
|---|---|---|---|
| 0101007 | 2/1984 | European Pat. Off. | 422/255 |
| 0289422 | 11/1988 | European Pat. Off. | 366/172 |
| 1569288 | 6/1980 | United Kingdom | 422/255 |

*Primary Examiner*—Gary P. Straub
*Assistant Examiner*—Timothy C. Vanoy
*Attorney, Agent, or Firm*—Sprung Horn Kramer & Woods

[57] ABSTRACT

The invention relates to a process in which a melt is mixed with, and emulsified in a colder aqueous phase at a temperature below the crystallization point of the molten compound, the melt only solidifying in the form of the dispersed particles after the emulsification step. To this end, the melt is sprayed into the aqueous phase to form a preliminary emulsion (12) and the preliminary emulsion is finely dispersed for 0.005 s to 0.15 s in a following homogenization nozzle (8) to form an emulsion (15) which then solidifies to form the final crystal suspension. The particle size can be clearly and reproducibly adjusted through the nozzle pressure during the emulsification step. The process may be used in particular for the production of highly concentrated dispersions of high-melting organic materials.

6 Claims, 2 Drawing Sheets

PRODUCTION OF DISPERSIONS OF SPHERICAL PARTICLES BY CRYSTALLIZATION OF EMULSIONS

This application is a continuation of application Ser. No. 525,414, filed May 18, 1990, now abandoned.

BACKGROUND OF THE INVENTION

This invention relates to a process for the production of a finely divided crystal suspension in which a melt is mixed with, and emulsified in, a colder aqueous phase at a temperature below the crystallization point of the molten material, the melt solidifying in the form of the dispersed particles only after the emulsification step.

Melts are normally dispersed by initially dispersing the melt above its solidification temperature in an aqueous phase, followed by cooling to below the crystallization temperature of the organic phase. Cooling may take place in a stirred tank, by heat exchangers or by the water phase itself (cf, for example EP-A-221 465). The disadvantage of this process is that relatively large crystals grow from the dispersed particles. It is also known that a melt can be dispersed in an aqueous phase having a temperature below the solidification temperature of the melt. According to DE-PS 2 551 841 and 29 00 268 for example, dispersions of this type are produced using high-speed stirrers or rotor-stator machines. The disadvantage of these processes is that they only give coarse dispersions with short shelf life. The formation of stable dispersions requires either stirred storage tanks (DE-PS 2 900 268), the addition of thickeners or an additional homogenization step (DE-PS 2 551 841), for example in stirred ball mills.

The problem addressed by the present invention was further to develop and improve the emulsion crystallization process described above in such a way that very finely divided crystal suspensions of spherical particles (particle diameter $\leqq \mu m$) can be economically produced at high throughputs.

SUMMARY OF THE INVENTION

According to the invention, this problem was solved by spraying the melt into the liquid phase to form a preliminary emulsion and finely dispersing the preliminary emulsion for 0.005 to 0.15 s and preferably for 0.01 s to 0.1 s after spraying in a following homogenizing nozzle to form an emulsion which then solidifies to form the final crystal suspension. More particularly, the residence time in the emulsification step is kept so short in accordance with the invention that emulsification is complete as long as the melt is still liquid and of low viscosity. With relatively long residence times, it was found that relatively coarse, high-viscosity dispersions with no storage life are formed. By virtue of the short residence time in the emulsification step, emulsification can be carried out at very low temperatures far below the crystallization temperature. The dispersed particles are thus cooled so quickly that they retain their spherical shape. Accordingly, emulsification takes place faster than solidification. In addition, the solubility of the melt in the liquid is considerably reduced by the low temperature.

The melt is preferably sprayed into the aqueous phase in short distance from the homogenizing nozzle. A jet disperser with several capillary bores is preferentially used as the homogenizing nozzle.

It has also been found that the size of the particles can be specifically adjusted through the nozzle pressure during emulsification of the melt. The higher the pressure, the finer the emulsion.

As already mentioned, the resulting mixing temperature after spraying of the melt into the aqueous phase must be below the solidification temperature of the melt. If this requirement is not satisfied a priori, the process according to the invention can advantageously be modified by partly recirculating and cooling the crystal suspension and then circulating it through the emulsification zone. The requirement stated above is thus satisfied.

The following advantages are afforded by the invention:

Low-viscosity crystal suspensions of spherical particles can be produced in a single process step.

Very high throughputs can be achieved under economic conditions.

Very finely divided dispersions having a narrow particle size distribution are obtained. The dispersions are considerably finer than the dispersions obtained by conventional rotor/stator dispersion machines. There is no need for addition of thickeners in order to improve dispersion stability.

The particle size can be adjusted clearly and reproducibly through the nozzle pressure during emulsification.

The process can be successfully used for the production of highly concentrated dispersions of high-melting organic compounds.

The process according to the invention is described by examples in the following with reference to the accompanying drawings, wherein:

BRIEF DESCRIPTION OF THE DRAWINGS

Referring to FIG. 1, the melt and the water phase are continuously delivered from the storage vessels 1 and 2 via the filters 3 and 4 to the mixing nozzle 7 and the following homogenizing nozzle 8 by the metering pumps 5 and 6. The necessary mixing and homogenization pressure is supplied by the pumps. The mixing ratio of melt to water phase is selected so that the resulting mixing temperature is lower than the solidification temperature of the melt. If this requirement cannot be satisfied a priori, the dispersion has to be at least partly recirculated through a heat exchanger 9 into the holding tank 2. In addition, temperature controllers TI, pressure controllers PI and volume flow meters FIR are provided. The emulsion issuing from the homogenizing nozzle 8 is cooled until the melt has solidified in the form of the dispersed spherical particles. The final crystal suspension is discharged into the tank 10.

Referring to FIG. 2, the melt is sprayed through the nozzle 7 into the water phase (pipe) 11 laterally introduced at the same level. A preliminary emulsion 12 is thus produced, entering the homogenizing nozzle 8 after a very short residence time of $<0.1$ s. The homogenizing nozzle used in the present case is a jet disperser which consists of an axial tube 13 closed upstream with several capillary of bores 14. The preliminary emulsion 12 is dispersed to the finely divided emulsion 15 in the jet disperser. The residence time of the preliminary emulsion between the mixing nozzle 7 and the jet disperser 8 is so short that the melt droplets do not solidify before passing through the jet disperser. Instead, solidification only starts after the jet disperser and proceeds so quickly that the emulsion particles retain their spherical shape. The construction and operation of a jet disperser are described in more detail in DE-32 30 289 (EP 0 101 007).

Figure 3:
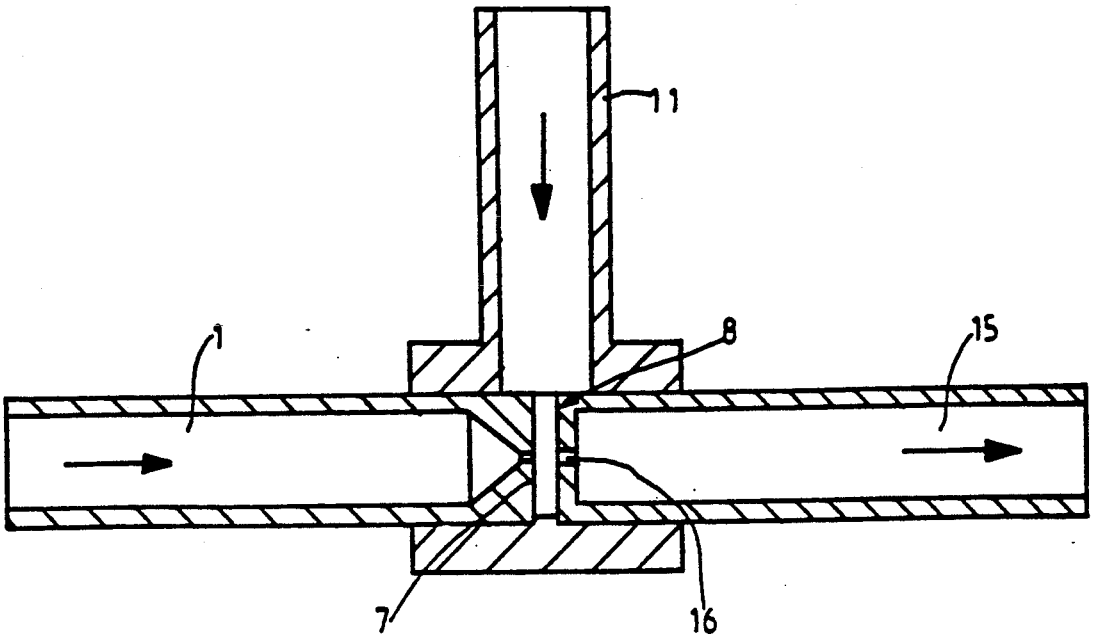
FIG. 3 shows a dispersion unit operating on the same principle (as in FIG. 2) in which the melt is sprayed in immediately before the homogenization step.

In the dispersion unit shown in FIG. 3, the emulsification stage (mixing nozzle 7) and the homogenizing nozzle 8 in the form of an axial bore 16 are arranged in short distance from each other. The distance between them is only a few millimeters. This arrangement provides for extremely short residence times of the preliminary emulsion.

The process according to the invention is particularly suitable for the production of highly concentrated finely divided dispersions of high-melting organic compounds. However, it is essential in this regard that the melt does not dissolve in, or form a homogeneous mixed phase with, the liquid phase. To improve emulsifiability, emulsifiers may be added in known manner to the melt or to the aqueous phase.

EXAMPLE 1

Figure 1:
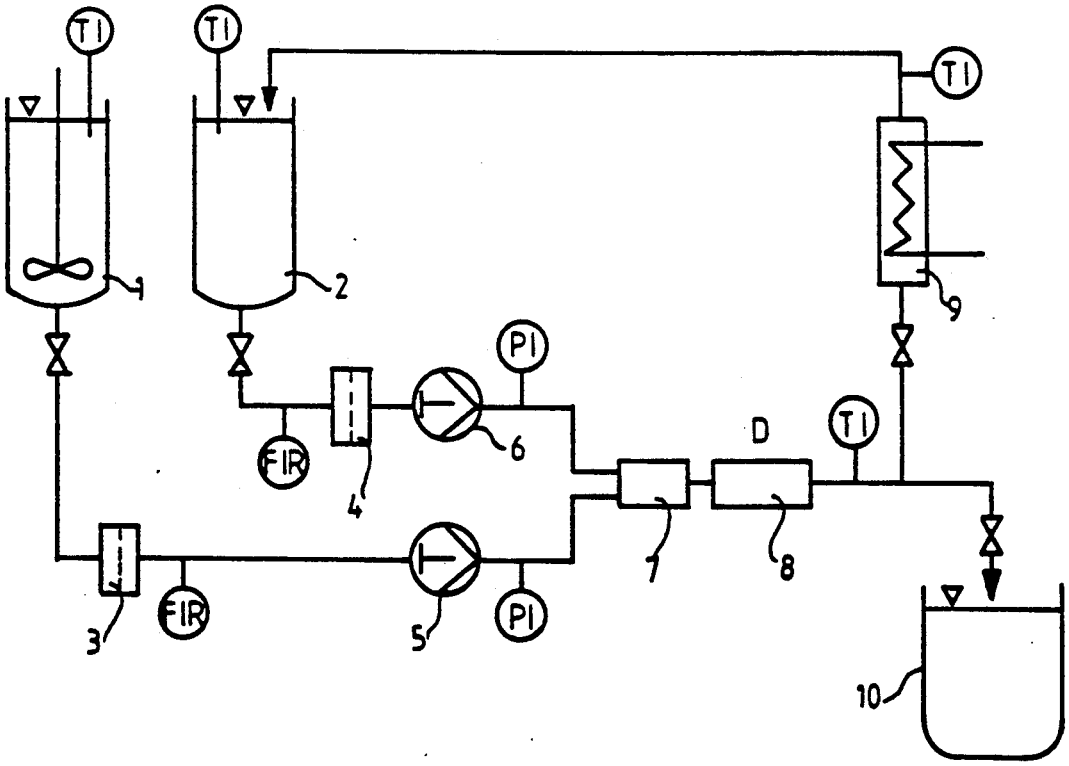
FIG. 1 shows a flow chart of the process.
Figure 2:
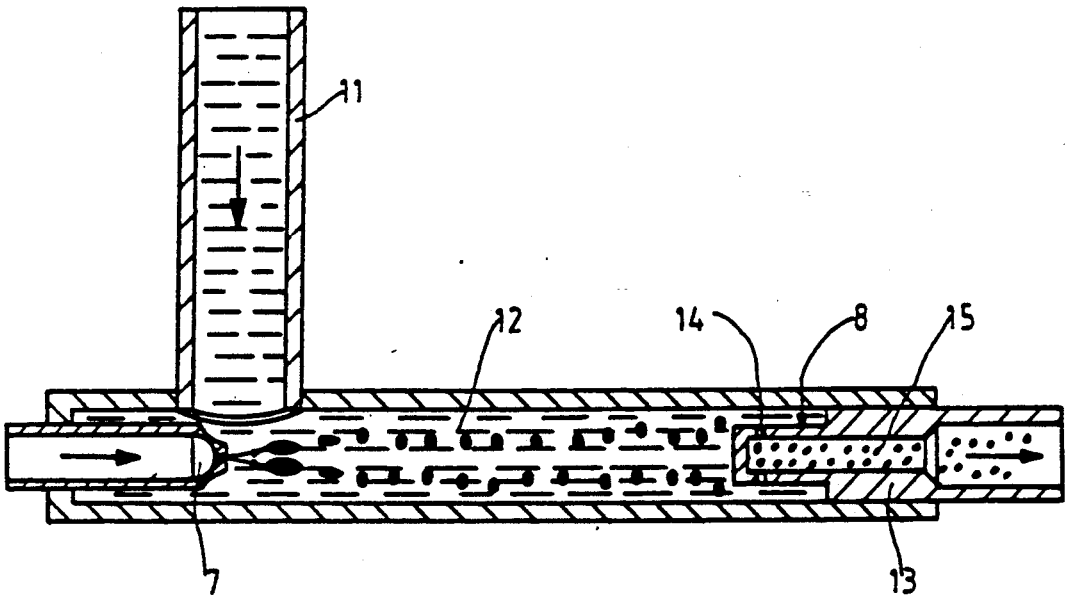
FIG. 2 shows the dispersion unit with spraying-in of the melt into the water phase and the homogenization step.

A paraffin-water suspension was prepared as follows using the system shown in FIG. 1 and the dispersion unit shown in FIG. 2.

30 Parts of a paraffin melt were prepared at 120° C. in tank 1 while 70 parts of water were heated to 60° C. in tank 2. The paraffin melt had the following composition:

| | |
|---|---|
| 75.2 parts | Hartparaffin (hard paraffin) EH 100, a product of Huls, |
| 12.73 parts | emulsifier of a partly crosslinked behenic acid fatty acid amide, |
| 4.29 parts | emulsifier of Dobanol 23 ® reacted with 4 mols of ethylene oxide, |
| 6.79 parts | emulsifier of nonylphenol reacted with 12 mols of ethylene oxide, |
| 0.99 parts | glacial acetic acid. |

The diameter of the mixing and emulsifying nozzle 7 was 0.6 mm and the diameter of the bores 14 in the jet disperser was 0.75 mm. The paraffin melt and the aqueous phase were delivered to the mixing nozzle 7 by means of the metering pumps 5 and 6 under pressures of 30 bar and 12 bar and at flow rates of 46 kg/h and 88 kg/h, respectively. The residence time in the emulsification zone was approximately 0.1 s. After fine dispersion, the emulsion solidified to a crystal suspension of spherical particles having an average diameter of approximately 0.5 μm. The average particle diameter could be systematically varied or controlled between 0.2 μm and 1μm by selecting the appropriate pressure at the mixing nozzle 7.

EXAMPLE 2

A melt of 15 parts of a commercial plant protection agent (Baytan ®), 0.75 parts Aerosil 300 ® (a product of Degussa), 5.0 parts emulsifier of phenol reacted with 27 mols of ethylene oxide and 2.5 parts emulsifier of stearyl alcohol reacted with 50 mols of ethylene oxide is prepared in tank 1 at a temperature of 120° C. 71.75 parts of water and 5.0 parts of a 2% aqueous solution of a protective colloid (Kelzan ®, a product of Kelco, USA) are mixed in tank 2 and cooled to 2° C.

The diameter of the mixing nozzle 7 was 0.4 mm and the diameter of the bore 16 (FIG. 3) was 0.6 mm. The melt and the aqueous phase were delivered to the mixing nozzle 7 by piston metering pumps 5 and 6 under pressures of 65 bar and 50 bar, respectively. The residence time in the emulsification zone was approx. 0.01 s. After fine dispersion, the emulsion solidified to a low viscosity crystal suspension of spherical particles having an average particle size of 1.2 μm. The mixing temperature was 18° C. With agitation and cooling in tank 10 for 4 hours at a temperature below 20° C., a plant protection suspension with good storage stability at low and high temperatures was obtained.

At mixing temperatures above 20° C., acicular crystals rather than spherical particles are formed.

In this case, subsequent cooling is necessary to ensure that the interior of the particles also solidifies thereby preventing subsequent recrystallization, crystal growth or breakdown of the dispersion.

We claim:

1. A process for the production of a finely dispersed crystal suspension of an organic compound comprising the steps of a) spraying a melt of the organic compound into an aqueous phase having a temperature below the crystallization point of the molten organic compound, in such a manner that the mixing ratio of melt to aqueous phase results in a mixture, the temperature of the mixture being lower than the solidification or crystallization temperature of the melt to form a preliminary emulsion, and b) feeding the preliminary emulsion within a residence time of 0.005 s to 0.15 s through a homogenizing nozzle to form a finely dispersed emulsion, thereby solidifying the finely dispersed emulsion to form a final crystal suspension.

2. A process according to claim 1, wherein the residence time is from about 0.01 s to 0.1 s.

3. A process according to claim 1, wherein the melt is sprayed into the aqueous phase immediately before the homogenizing nozzle.

4. A process according to claim 1, wherein a jet disperser comprising one or more capillary bores is used as the homogenizing nozzle.

5. A process according to claim 1, wherein the particle size is specifically adjusted by varying the pressure under which the melt is sprayed into the aqueous phase.

6. A process according to claim 1, wherein the crystal suspension is partly recirculated and cooled and then passed through the emulsification zone.

* * * * *